US010927540B2

(12) United States Patent
Gentilcore et al.

(10) Patent No.: US 10,927,540 B2
(45) Date of Patent: Feb. 23, 2021

(54) CONSTRUCTION SYSTEM FOR STRUCTURAL FRAMEWORKS OF BUILDINGS

(71) Applicant: LEAPFACTORY S.R.L., Turin (IT)

(72) Inventors: Luca Gentilcore, Turin (IT); Stefano Testa, Turin (IT)

(73) Assignee: LEAPFACTORY S.R.L., Turin (IT)

( * ) Notice: Subject to any disclaimer, the term of this patent is extended or adjusted under 35 U.S.C. 154(b) by 16 days.

(21) Appl. No.: 16/608,479

(22) PCT Filed: Mar. 23, 2018

(86) PCT No.: PCT/IT2018/000043
§ 371 (c)(1),
(2) Date: Oct. 25, 2019

(87) PCT Pub. No.: WO2018/198145
PCT Pub. Date: Nov. 1, 2018

(65) Prior Publication Data

US 2020/0056366 A1 Feb. 20, 2020

(30) Foreign Application Priority Data

Apr. 28, 2017 (IT) ..... 102017000045810

(51) Int. Cl.
*E04B 1/26* (2006.01)
*E04C 2/38* (2006.01)
*E04B 1/19* (2006.01)

(52) U.S. Cl.
CPC ..... *E04B 1/2604* (2013.01); *E04C 2/386* (2013.01); *E04B 2001/1975* (2013.01);
(Continued)

(58) Field of Classification Search
None
See application file for complete search history.

(56) References Cited

U.S. PATENT DOCUMENTS 2,332,081 A * 10/1943 Hunt ..... E04C 2/24 52/586.1
4,127,929 A * 12/1978 Zapara ..... A47B 47/04 108/59

(Continued)

FOREIGN PATENT DOCUMENTS

| | | | |
|---|---|---|---|
| FR | 2219674 | A7 | 9/1974 |
| WO | 9709492 | A2 | 3/1997 |
| WO | 2016097452 | A1 | 6/2016 |

*Primary Examiner* — Joshua K Ihezie
(74) *Attorney, Agent, or Firm* — Maschoff Brennan

(57) ABSTRACT

A construction system for structural frameworks of buildings is described, comprising a first and a second structural elements mutually connected by connecting elements, the first and second structural elements being vertically assembled to make a pillar of the framework, a third and a fourth structural elements mutually connected by connecting elements to make a beam of the framework, the third and fourth structural elements being assembled transversally to the first and second structural elements, the third and/or fourth structural elements being associated as joint to the first and/or to the second structural element, the third and fourth structural elements being further connected to the first and the second structural elements by connecting elements, to make the framework, the first, second, third and fourth structural elements being composed of a panel having height and width greater than the thickness.

16 Claims, 3 Drawing Sheets

(52) U.S. Cl.
CPC ..... *E04B 2001/1993* (2013.01); *E04B 2001/2652* (2013.01); *E04B 2001/2672* (2013.01)

(56) References Cited

U.S. PATENT DOCUMENTS

| | | | | | |
|---|---|---|---|---|---|
| 5,650,210 | A * | 7/1997 | Fujii | B27M 3/002 | 144/347 |
| 5,813,737 | A * | 9/1998 | Stone | F16B 12/48 | 108/155 |
| 6,032,434 | A * | 3/2000 | Graf | E04B 1/26 | 52/309.11 |
| 10,174,497 | B2 | 1/2019 | Perez Romero et al. | | |
| 2005/0055966 | A1 * | 3/2005 | Conroy | E04C 3/12 | 52/120 |
| 2007/0227095 | A1 * | 10/2007 | Hubbe | E04C 3/16 | 52/653.1 |
| 2008/0053031 | A1 * | 3/2008 | Sandoz | E04C 2/386 | 52/649.1 |
| 2017/0370090 | A1 * | 12/2017 | Perez-Romero | E04B 1/2604 | |

* cited by examiner

CONSTRUCTION SYSTEM FOR STRUCTURAL FRAMEWORKS OF BUILDINGS

BACKGROUND OF THE INVENTION

1) Field of the Invention

The present invention refers to a construction system for structural frameworks of buildings, in particular for structural frameworks comprising pre-fabricated wooden elements.

2) Background Art

Several constructions systems for structural frameworks of buildings are known in the art, in particular for structural frameworks comprising wooden pre-fabricated elements, which generally provide for the use of structural elements such as beams and pillars, which are installed in a yard, working them to modify their shape or length, and drilling them in order to couple them using both connecting elements, such as pins or pegs which work under shearing, and screws and structural metallic plates coupled with bolts, in order to mutually assemble the framework elements by working under compression.

These known construction systems has the problems of requiring further workings in the year to assemble the structural elements, which are further cumbersome to be transported.

SUMMARY OF THE INVENTION

Object of the present invention is solving the above prior art problems, by providing a construction system for structural frameworks of buildings which can be made using scarcely cumbersome structural elements, which are thereby easy to transport and to install, made with a limited number of standardized components, available in pre-arranged assembling kits, which do not require further workings in a yard for their installation.

The above and other objects and advantages of the invention, as will appear from the following description, are obtained with a construction system for structural frameworks of buildings as claimed in claim 1. Preferred embodiments and non-trivial variations of the present invention are the subject matter of the dependent claims.

It is intended that all enclosed claims are an integral part of the present description.

It will be immediately obvious that numerous variations and modifications (for example related to shape, sizes, arrangements and parts with equivalent functionality) can be made to what is described, without departing from the scope of the invention as appears from the enclosed claims.

BRIEF DESCRIPTION OF THE DRAWINGS

The present invention will be better described by some preferred embodiments thereof, provided as a non-limiting example, with reference to the enclosed drawings, in which.

DETAILED DESCRIPTION OF PREFERRED EMBODIMENTS

Figure 1:
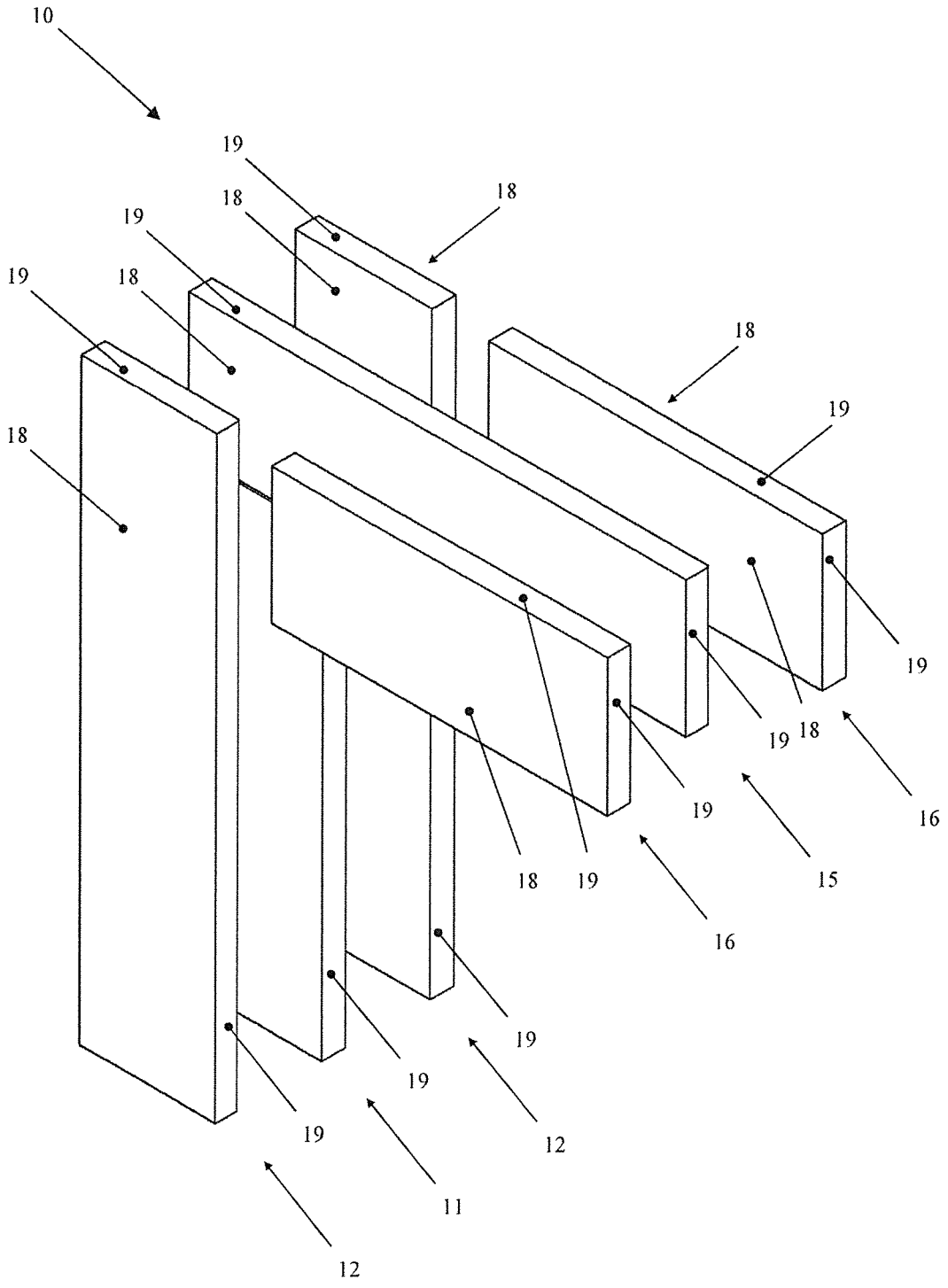
FIG. 1 is a partial exploded view of a first embodiment of a construction system for structural frameworks of buildings according to the present invention.

With reference to the Figures, preferred embodiments of the construction system for structural frameworks of buildings of the present invention are shown and described.

The construction system 10 for structural frameworks of buildings of the present invention comprises at least one first structural element 11 and at least one second structural element 12, mutually connected by means of connecting elements, the first 11 and second 12 structural elements being adapted to be vertically assembled to make a pillar of the structural framework.

The construction system 10 for structural frameworks of buildings of the present invention further comprises at least one third structural element 15 and at least one fourth structural element 16, mutually connected by means of connecting elements to make a beam of the structural framework, the third 15 and fourth 16 structural elements being adapted to be transversally assembled, preferably perpendicular to the first 11 and the second 12 structural elements, to make the structural framework.

Preferably, the third 15 and/or the fourth 16 structural elements are associated as a joint to the first 11 and/or al second 12 structural element to make the structural framework; preferably, the third 15 and/or the fourth 16 structural element are further connected to the first 11 and/or to the second 12 structural elements by means of connecting elements.

For example, the connecting elements comprise screws and/or bolts, and are adapted to keep mutually connected and blocked the structural elements 11, 12, 15 and 16, abutted one to the other on abutment surfaces 18.

The first 11, the second 12, the third 15 and the fourth 16 structural elements are composed of a panel, preferably made of wood, more preferably made of lamellar wood, having height and width which are much greater than its thickness, which is for example the same for all structural elements and equal to 20 mm, or 40 mm, or 60 mm, in order to allow their working with machines in two dimensions, and enable their transport before their assembly.

In particular, the first 11, the second 12, the third 15 and the fourth 16 structural elements are each composed of a panel having two opposite bearing surfaces 18, on which the structural elements 11, 12, 15 and 16 are adapted to be mutually abutted, when they are assembled to form the structural framework of the construction system 10 of the invention; the bearing surfaces 18 are those having height and width much greater than those of the side surfaces 19 of the panel, whose width is the same as the panel thickness.

Preferably, the construction system 10 for structural frameworks of buildings of the invention comprises the first structural element 11 inserted between two second structural elements 12 to form the pillar of the structural framework, and comprises the third structural element 15 inserted between two fourth structural elements 16 and between the two second structural elements 12, preferably between two upper ends thereof, to form the beam of the structural framework, the first 11, second 12, third 15 and fourth 16 structural elements being assembled with their respective abutment surfaces 18 mutually in contact; the third structural element 15 is further abutted with its side surface 19 onto a side surface 19 of the first structural element 11, to form a structural engagement; further, the first structural element 11 is connected to the two second structural elements 12 by means of connecting elements, the third structural element 15 is connected to the two fourth structural elements 16 by means of connecting elements, and the third structural element 15 is connected to the two second structural elements 12 by means of connecting elements to form the structural framework.

In a first embodiment of the construction system 10 for structural frameworks of buildings of the invention, shown in FIG. 1, the two second structural elements 12 are abutted to the first structural element 11 and to the third structural element 15, preferably at an end of the third structural element 15, with the respective abutment surfaces 18 mutually in contact, and the two fourth structural elements 16 are each abutted to the third structural element 15, with the two abutment surfaces 18 of the third structural element 15 in contact each with one of the abutment surfaces 18 of one of the fourth structural elements 16; the third structural element 15 is further abutted with its side surface 19 to a side surface 19 of the first structural element 11, to form a structural engagement and make thereby the structural framework of the construction system 10 of the invention.

Figure 2:
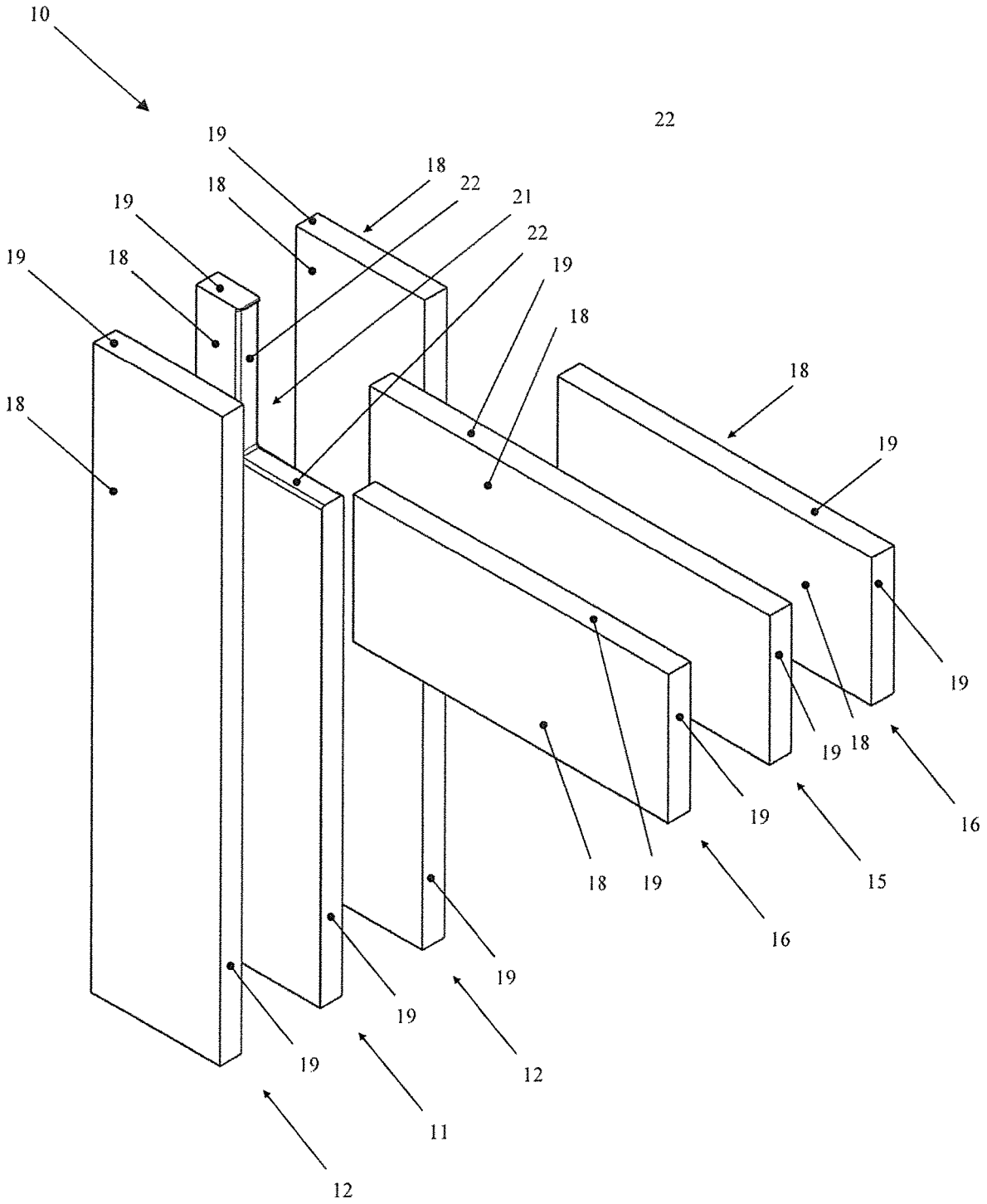
FIG. 2 is a partial exploded view of a second embodiment of a construction system for structural frameworks of buildings according to the present invention.

In a second embodiment of the construction system 10 for structural frameworks of buildings of the invention shown in FIG. 2, the two second structural elements 12 are abutted to the first structural element 11 and to the third structural element 15, preferably at an end of the third structural element 15, with the respective abutment surfaces 18 mutually in contact, and the two fourth structural elements 16 are each abutted to the third structural element 15, with the two abutment surfaces 18 of the third structural element 15 in contact each with one of the abutment surfaces 18 of one of the fourth structural elements 16; the first structural element 11 further comprises a seat 21 having two side walls 22, onto which two side surfaces 19 of the third structural element 15 are adapted to abut, to form a structural engagement and make thereby the structural framework of the construction system 10 of the invention.

Figure 3:
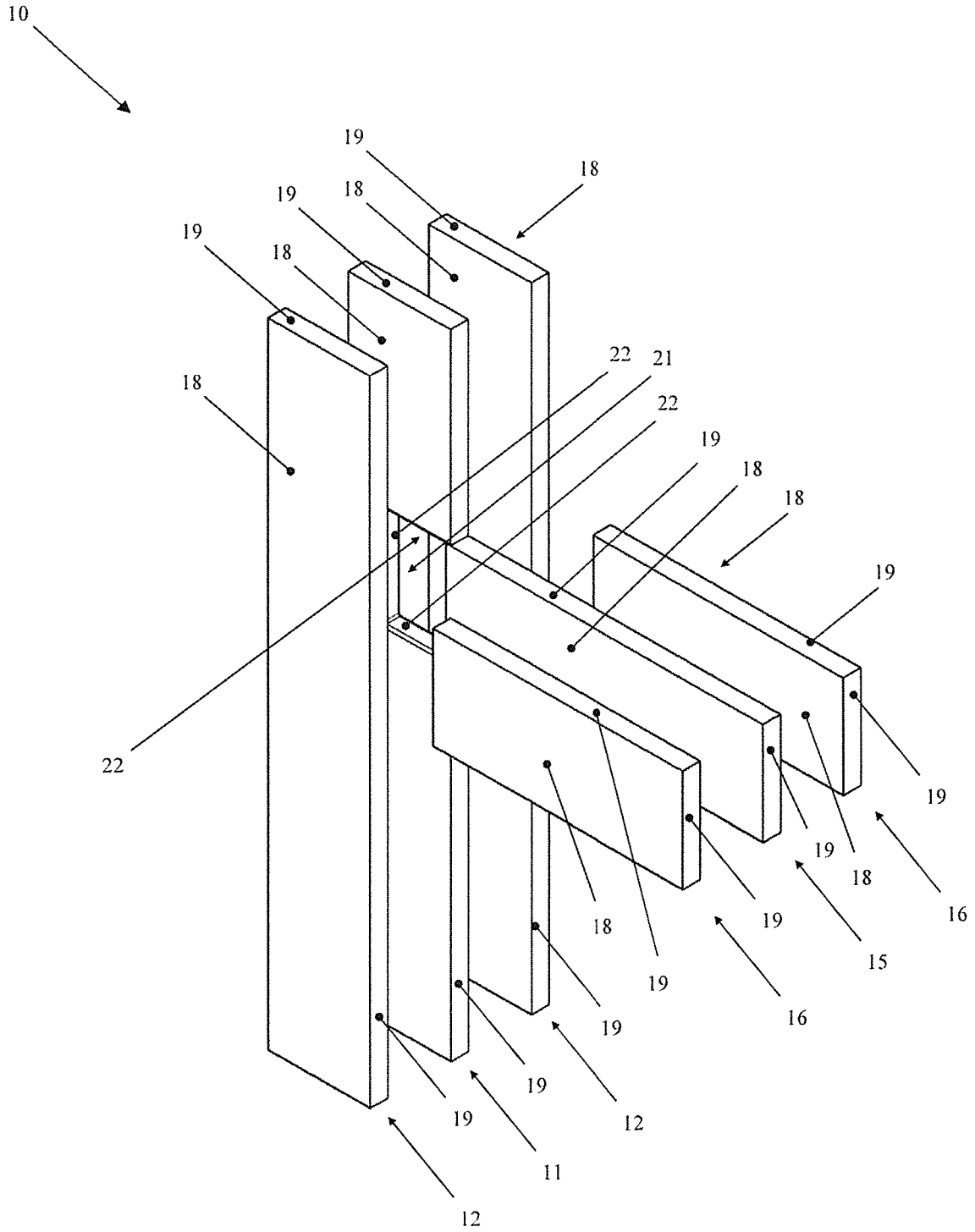
FIG. 3 is a partial exploded view of a third embodiment of a construction system for structural frameworks of buildings according to the present invention.

In a third embodiment of the construction system 10 for structural frameworks of buildings of the invention shown in FIG. 3, the two second structural elements 12 are abutted to the first structural element 11 and to the third structural element 15, preferably at an end of the third structural element 15, with the respective abutment surfaces 18 mutually in contact, and the two fourth structural elements 16 are each abutted to the third structural element 15, with the two abutment surfaces 18 of the third structural element 15 in contact each with one of the abutment surfaces 18 of one of the fourth structural elements 16; the first structural element 11 further comprises a seat 21 having three side walls 22, onto which three side surfaces 19 of the third structural element 15 are adapted to abut, to form a structural engagement and make thereby the structural framework of the construction system 10 of the invention.

Advantageously, the construction system 10 for structural frameworks of buildings according to the present invention allows using scarcely cumbersome structural elements composed of panels with reduced thickness, which are thereby easy to transport and install, made with a limited number of standardized components, which can be assembled without using additional plates, available in pre-arranged assembling kits before their shipment, which do not require further workings for their installation in a yard.

The invention claimed is:

1. A construction system for structural frameworks of buildings comprising:

at least one first structural element and at least one second structural element mutually connected by means of connecting elements, the first structural elements and the second structural elements being adapted to be vertically assembled to make a pillar of the structural framework;

at least one third structural element and at least one fourth structural element mutually connected by means of connecting elements to make a beam of the structural framework, the third structural elements and the fourth structural elements being adapted to be transversally assembled to the first structural elements and to the second structural elements;

wherein the third structural elements and/or the fourth structural elements are associated as a joint to the first structural elements and/or to the second structural elements, the third structural elements and/or the fourth structural elements being further connected to the first structural elements and/or to the second structural elements by means of connecting elements, to make the structural framework;

wherein the first structural elements, the second structural elements, the third structural elements and the fourth structural elements are composed of a panel having greater height and width with respect to its thickness;

wherein the second structural elements are abutted to the first structural elements and to the third structural elements with the respective abutment surfaces mutually in contact, and the fourth structural elements are abutted each to the third structural elements with the two abutment surfaces of the third structural elements in contact each with one of the abutments surfaces of one of the fourth structural elements; and wherein the first structural elements further comprise a seat having two side walls on which two side surfaces of the third structural elements are adapted to abut, to form a structural engagement and make the structural framework of the construction.

2. The construction system for structural frameworks of buildings of claim 1, wherein the first structural elements, the second structural elements, the third structural elements and the fourth structural elements are each composed of a panel having two opposite bearing surfaces, onto which the first, second, third and fourth structural elements are adapted to be mutually abutted, when they are assembled to form the structural framework of the construction system, the bearing surfaces being the surfaces of the panel whose height and width are greater than those of the side surfaces of the panel, whose width is equal to the panel thickness.

3. The construction system for structural frameworks of buildings of claim 1, wherein one of the first structural elements is inserted between two second structural elements to form the pillar of the structural framework, and one of the third structural elements is inserted between two fourth structural elements and between the two second structural elements to form the beam of the structural framework.

4. The construction system for structural frameworks of buildings of claim 3, wherein the first, second, third and fourth structural elements are assembled with the respective abutment surfaces mutually in contact, and one of the third structural elements is further abutted with a side surface thereof to a side surface one of the first structural elements to form a structural engagement.

5. The construction system for structural frameworks of buildings of claim 4, wherein one of the first structural elements is connected to the two second structural elements by means of connecting elements, one of the third structural elements is connected to the two fourth structural elements by means of connecting elements, and the one of the third structural elements is connected to the two second structural elements by means of connecting elements to form the structural framework.

6. The construction system for structural frameworks of buildings of claim 1, wherein the second structural elements are abutted to the first structural elements and to the third structural elements with the respective abutment surfaces mutually in contact, and the fourth structural elements are abutted each to the third structural element, with the two abutment surfaces of the third structural elements in contact each with one of the abutment surfaces of one of the fourth structural elements, and wherein one of the third structural elements is further abutted with a side surface thereof to a side surface of one of the first structural elements to form a structural engagement and make the structural framework of the construction system.

7. The construction system for structural frameworks of buildings of claim 1, wherein the first, the second, the third and the fourth structural elements are composed of a panel made of lamellar wood.

8. The construction system for structural frameworks of buildings of claim 1, wherein the connecting elements comprise screws and/or bolts.

9. A construction system for structural frameworks of buildings comprising:

at least one first structural element and at least one second structural element mutually connected by means of connecting elements, the first structural elements and the second structural elements being adapted to be vertically assembled to make a pillar of the structural framework;

at least one third structural element and at least one fourth structural element mutually connected by means of connecting elements to make a beam of the structural framework, the third structural elements and the fourth structural elements being adapted to be transversally assembled to the first structural elements and to the second structural elements;

wherein the third structural elements and/or the fourth structural elements are associated as a joint to the first structural elements and/or to the second structural elements, the third structural elements and/or the fourth structural elements being further connected to the first structural elements and/or to the second structural elements by means of connecting elements, to make the structural framework;

wherein the first structural elements, the second structural elements, the third structural elements and the fourth structural elements are composed of a panel having greater height and width with respect to its thickness;

wherein the second structural elements are abutted to the first structural elements and to the third structural elements with the respective abutment surfaces mutually in contact, and the fourth structural elements are abutted each to the third structural elements with the two abutment surfaces of the third structural elements in contact each with one of the abutment surfaces of one of the fourth structural elements; and wherein the first structural elements further comprise a seat having three side walls on which three side surfaces of the third structural elements are adapted to abut to form a structural engagement and make the structural framework of the construction system.

10. The construction system for structural frameworks of buildings of claim 9, wherein the first structural elements, the second structural elements, the third structural elements and the fourth structural elements are each composed of a panel having two opposite bearing surfaces, onto which the first, second, third and fourth structural elements are adapted to be mutually abutted, when they are assembled to form the structural framework of the construction system, the bearing surfaces being the surfaces of the panel whose height and width are greater than those of the side surfaces of the panel, whose width is equal to the panel thickness.

11. The construction system for structural frameworks of buildings of claim 9, wherein one of the first structural elements is inserted between two second structural elements to form the pillar of the structural framework, and one of the third structural elements is inserted between two fourth structural elements and between the two second structural elements to form the beam of the structural framework.

12. The construction system for structural frameworks of buildings of claim 11, wherein the first, second, third and fourth structural elements are assembled with the respective abutment surfaces mutually in contact, and one of the third structural elements is further abutted with a side surface thereof to a side surface of one of the first structural elements to form a structural engagement.

13. The construction system for structural frameworks of buildings of claim 12, wherein one of the first structural elements is connected to the two second structural elements by means of connecting elements, one of the third structural elements is connected to the two fourth structural elements by means of connecting elements, and the one of the third structural elements is connected to the two second structural elements by means of connecting elements to form the structural framework.

14. The construction system for structural frameworks of buildings of claim 9, wherein the second structural elements are abutted to the first structural elements and to the third structural elements with the respective abutment surfaces mutually in contact, and the fourth structural elements are abutted each to the third structural elements, with the two abutment surfaces of the third structural elements in contact each with one of the abutment surfaces of one of the fourth structural elements, and wherein one of the third structural elements is further abutted with a side surface thereof to a side surface of one of the first structural elements to form a structural engagement and make the structural framework of the construction system.

15. The construction system for structural frameworks of buildings of claim 9, wherein the first, the second, the third and the fourth structural elements are composed of a panel made of lamellar wood.

16. The construction system for structural frameworks of buildings of claim 9, wherein the connecting elements comprise screws and/or bolts.

* * * * *